United States Patent [19]

Lawrence

[11] 3,937,459

[45] Feb. 10, 1976

[54] SORTING MACHINE

[75] Inventor: Frederick J. Lawrence, San Francisco, Calif.

[73] Assignees: Keith B. Stewart, Irvine; Peter Shea, Newport Beach, both of Calif.

[22] Filed: Sept. 16, 1974

[21] Appl. No.: 506,526

[52] U.S. Cl. ..... 271/173; 271/197

[51] Int. Cl.[2] ..... B65H 31/24

[58] Field of Search ..... 270/58; 271/64, 173, 176, 271/197, 199, 200, 223

[56] References Cited

UNITED STATES PATENTS

| | | | |
|---|---|---|---|
| 3,460,824 | 8/1969 | Bahr et al. | 271/173 |
| 3,484,101 | 12/1969 | Cassano | 271/173 |
| 3,586,311 | 6/1971 | Schulze | 271/173 |
| 3,709,480 | 1/1973 | Schulze et al. | 270/58 |
| 3,744,790 | 7/1973 | Hoffman | 271/173 |
| 3,774,906 | 11/1973 | Fagan et al. | 271/64 |
| 3,853,314 | 12/1974 | Anderson | 271/173 |

*Primary Examiner*—Evon C. Blunk
*Assistant Examiner*—Robert Saifer
*Attorney, Agent, or Firm*—Newton H. Lee, Jr.

[57] ABSTRACT

Sorting apparatus has vertically adjustable sheet receiving and feeding vacuum chamber and traveling belt mechanism which directs successive sheets to a receiver having vacuum chamber and traveling belt conveyor mechanism for transporting sheets to or past vertically spaced trays. Fingers are shiftable to and from positions to deflect sheets from the transport conveyor and cause sheets to enter the trays. The receiving and feeding mechanism and the receiver are separable at the vertical plane of the fingers between the fingers and the vertically extended traveling belts.

18 Claims, 10 Drawing Figures

SORTING MACHINE

BACKGROUND OF THE INVENTION

Sheet sorting machines have heretofore involved the transport of successive sheets from an input location to a bank of trays at which the sheets are sucessively directed into the trays by fingers which are disposed in the path of the sheets.

Such machines have long been desired for use, for example, with a variety of high speed dry copying machines. Differences in configuration and operation of the copying machines has necessitated in most cases, that the sorting machine be designed for use with a specific copying machine. A major factor has been the different elevations at which the copy paper is discharged from different makes of copying machines.

The construction of the pick off fingers and accessability to the machine for service, say in the event of paper jamming in the finger region, have also posed problems.

SUMMARY OF THE INVENTION

The present invention provides a sorting machine which is compact, efficient, easy to install in association with a wide variety of copying machines, and simple to operate and service.

More particularly, the sorting machine of the present invention has a novel paper transport. Conveyor belts are driven about a vacuum chamber having openings arranged to cause the sheets of paper to be held against the conveyor belts, a section of the vacuum chamber being vertically adjustable over a range of elevations enabling the paper inlet to the sorter to be adjusted to the necessary elevation adapting the sorter to use with a wide variety of copying machines.

The adjustable input conveying portion or section of the sorting machine and the receiver portion or section thereof, are mounted on a common base for movement towards and away from a copying machine, or other source of sheets to be sorted, as well as towards and away from one another. Thus not only can the sorter machine be moved as a whole away from the copying machine, or other source, but more importantly, the machine separates at the interface of the conveying section and the receiving section to facilitate access to the pick off finger region in the event of a paper jam at the critical location where the paper is removed from the conveyor and diverted to a receiver tray. The invention also provides novel pick off finger means for diverting sheets to the trays from the transport means, the fingers being constructed to be disposed in the path of a sheet and to deflect the sheet accurately towards the tray. To enable rapid sorting, the fingers are normally in an "open" position for engagement by an oncoming sheet, and are actuated to a "closed" position at which the fingers closely interfit to form a substantially plane surface comfronting the conveyor belts without rough edges, which might tend to hang up a paper sheet.

This invention possesses many other advantages, and has other purposes which may be made more clearly apparent from a consideration of the form in which it may be embodied. This form is shown in the drawings accompanying and forming part of the present specification. It will now be described in detail, for the purpose of illustrating the general principals of the invention; but it is to be understood that such detailed description is not to be taken in a limiting sense.

DESCRIPTION OF THE PREFERRED EMBODIMENT

Figure 1:
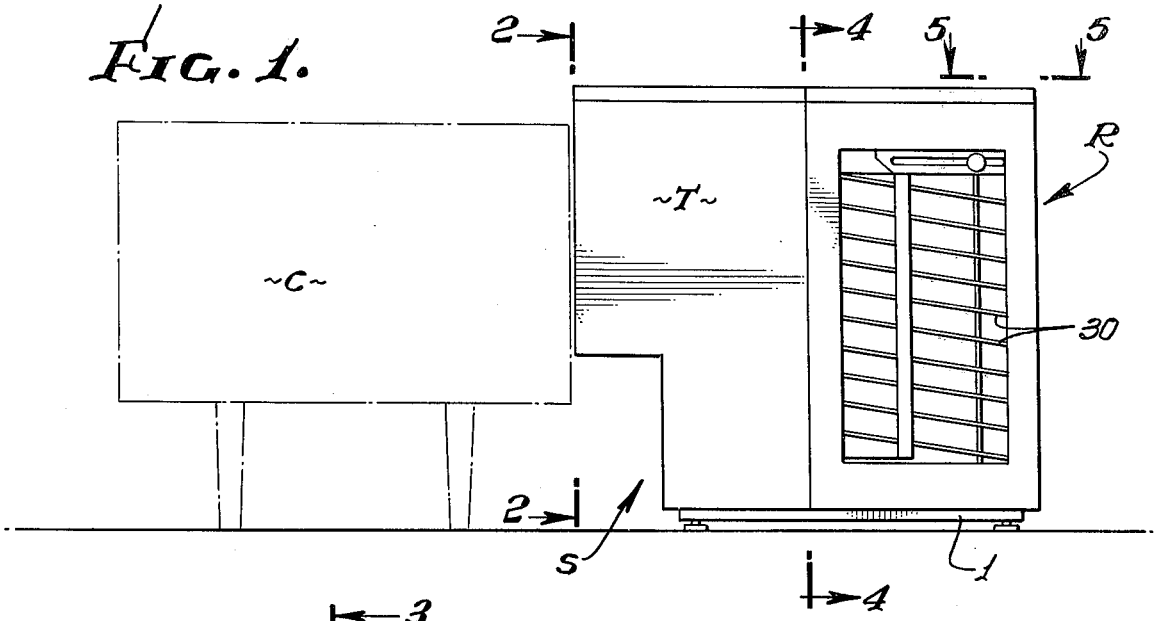
FIG. 1 is a side elevation of the sorting machine disposed adjacent to a typical copying machine shown in broken lines.
Figure 2:
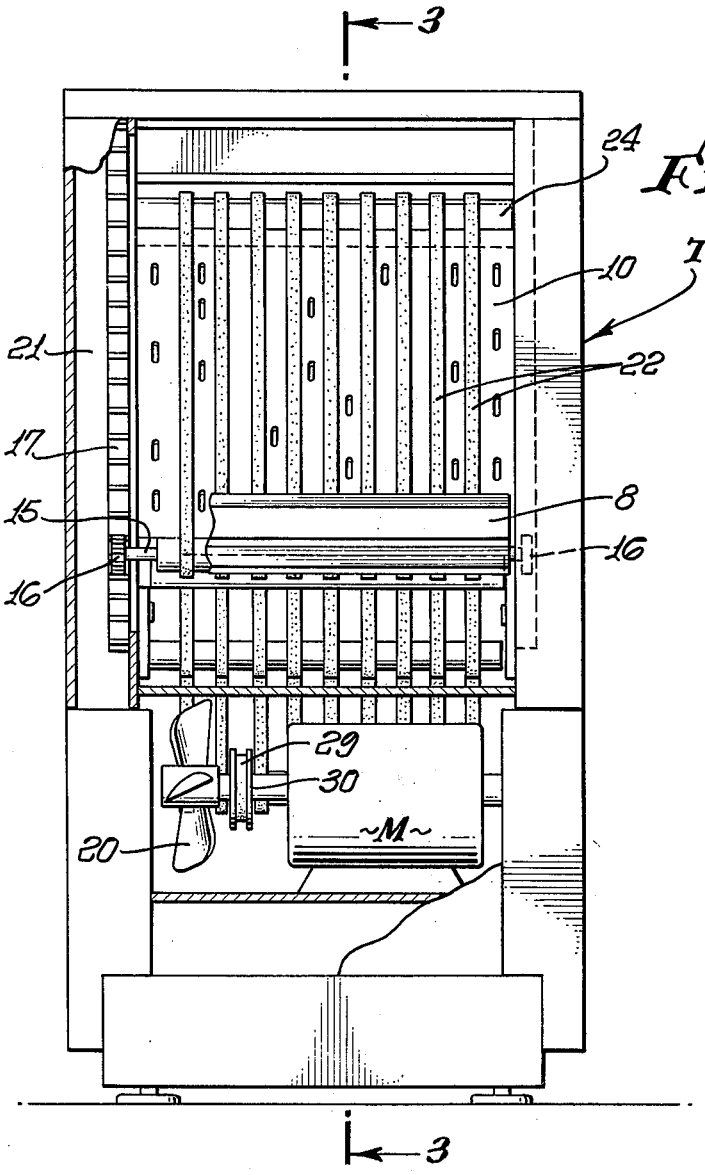
FIG. 2 is an enlarged view, as taken on the line 2—2 of FIG. 1, with portions broken away.

As seen in the drawings, a sorting machine S, made in accordance with the invention, comprises a base support 1 adapted to be placed adjacent to a source of sheets to be sorted, such as a copying machine C, shown in broken lines in FIG. 1, so that sheets can be supplied to a transport section T of the sorter and carried to the receiver section R of the sorter.

Figure 10:
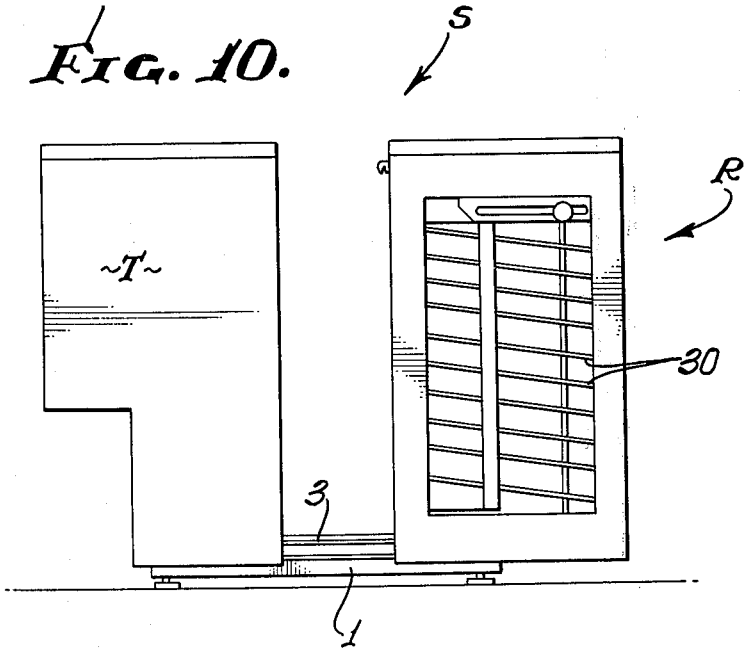
FIG. 10 is a side elevation showing the manner in which the transport section and receiving section are separable.

The base 1 includes a main frame 2 having side rails 3 on which slide means 4 (FIG. 4) support the receiver section R for movement away from the transport section T, as seen in FIG. 10 upon release of latch means 5 (best seen in FIG. 3), which normally hold the sections together during operation. The slide means 4 also support the transport section T and the receiver section R for movement as a unit, when the latch means 5 are engaged, towards and away from the copier or source C on the fixed base 1.

The transport section T has within a suitable case a vacuum chamber V defined by the side walls of the case, a rear wall 6 and an adjustable vacuum chamber section 7 which is adapted to be shifted vertically to dispose an inlet member 8 at a selected elevation. This enables the transport section to be associated with copiers or other sources which have sheet supply outlets at different elevations.

Figure 3:
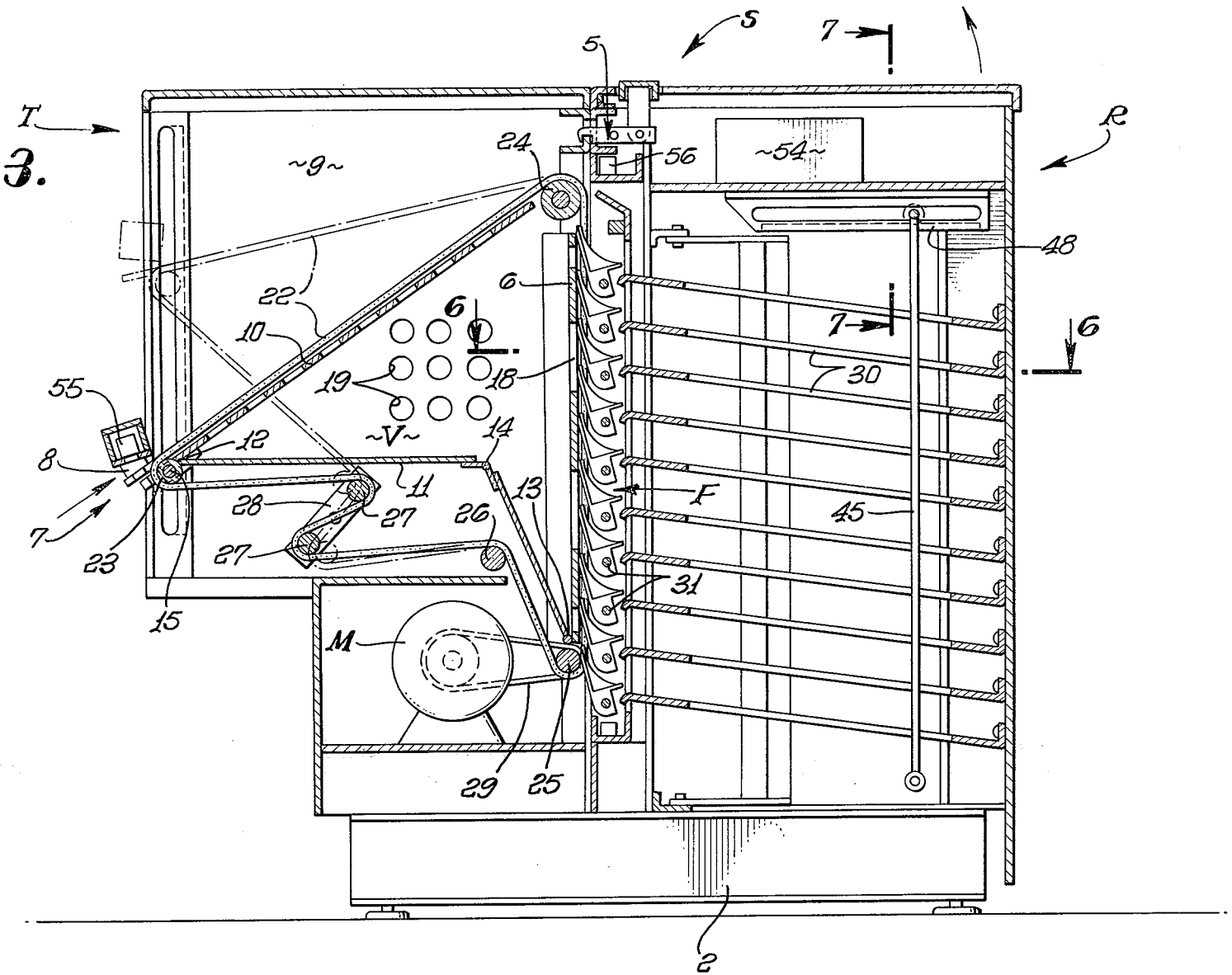
FIG. 3 is a vertical section as taken on the line 3—3 of FIG. 2.
Figure 4:
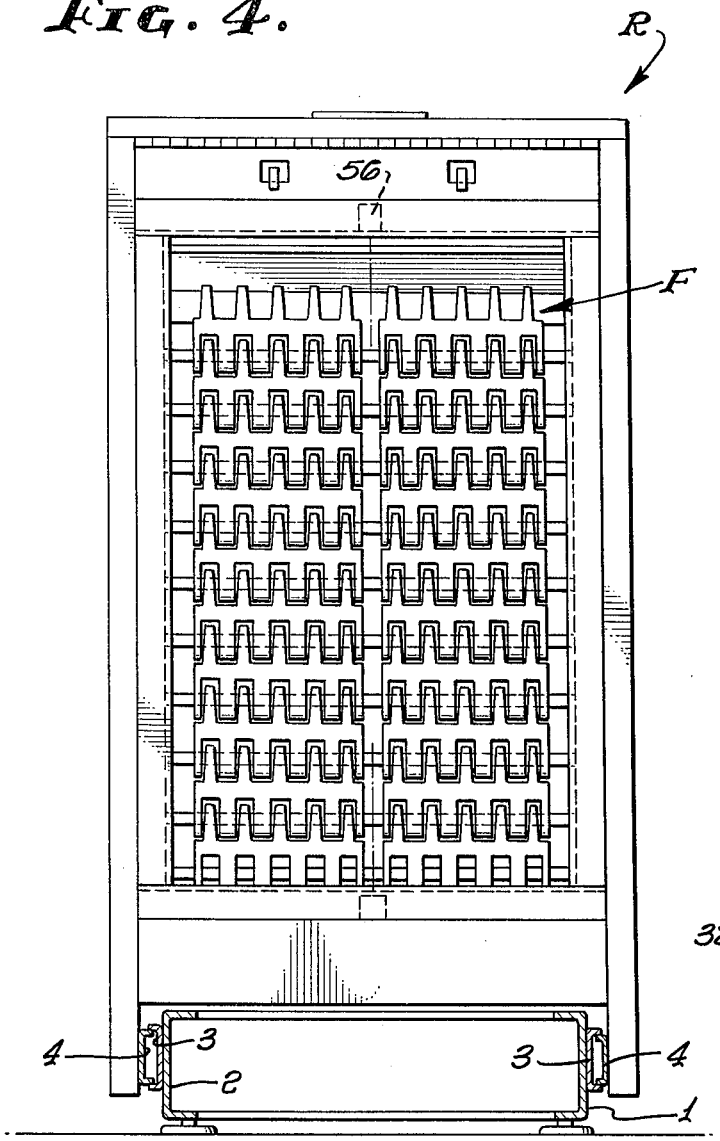
FIG. 4 is a vertical section as taken on the line 4—4 of FIG. 1.

The rear wall 6 is affixed between the side walls 9 of the case and the vertically adjustable section 7 of the vacuum chamber includes an upper plate or wall 10, which is suitably pivotally mounted between the side walls 9, at a point above the rear wall 6, for movement throughout a range of positions, including the full line and broken line positions of FIG. 3. An articulated lower wall 11 of the adjustable chamber section 7 is connected to the upper walls 10 at 12 and is pivotally connected at 13 to the rear wall 6, the wall 11 having a pivotal joint 14 between the connections 12 and 13 to enable the upper wall 10 to be moved through its range of adjustment.

A shaft 15 is disposed beneath the front side of the plate 10 and has pinions 16 at its ends engaged with equalizing racks 17 vertically supported in the case, whereby the inlet 8 is maintained in horizontal relation throughout its range of movement.

The top wall 10 and the rear wall 6 of the vacuum chamber V have suitable perforations or slots 18, and a side wall 9 has perforations or openings 19 whereby air is drawn into the chamber V through the perforations 18 and from the chamber through the perforations 19 by a suitable fan 20 driven by an electric motor M. The side wall of the housing provides a vertically extended chamber 21 exhausted by the fan 20 to cause the evacuation of the chamber V.

Extended about the chamber V is a number of laterally spaced sheet transporting belts 22. These belts extend in slightly spaced relation to the chamber walls about a front roller 23 revolvable about the shaft 15 at the paper inlet 8, a top roller 24 at the upper end of the top wall 10, a lower drive roller 25, beneath the chamber V, an idler roller 26, and a pair of tensioning rollers 27 mounted on a pivotal support 28 which may be biased to maintain tension on the belts 22 while enabling the chamber section 7 to be vertically adjusted. The belts 22 are driven by means of a drive belt 29 extending about a pulley 30 on the shaft of motor M, and the blet drive roller 25.

Accordingly, it will be seen that a sheet of paper supplied to the inlet 8 will be transported on the belts 22, while being held against the belts by reason of the reduced air pressure in the chamber V, upwardly along the upper wall 10 and then downwardly along the inner wall 6.

Sheets are picked off of the belts along the inner wall 6 by finger means F and directed into one of a suitable number of trays 30, depending upon the number of sheets to be sorted.

Figure 8:
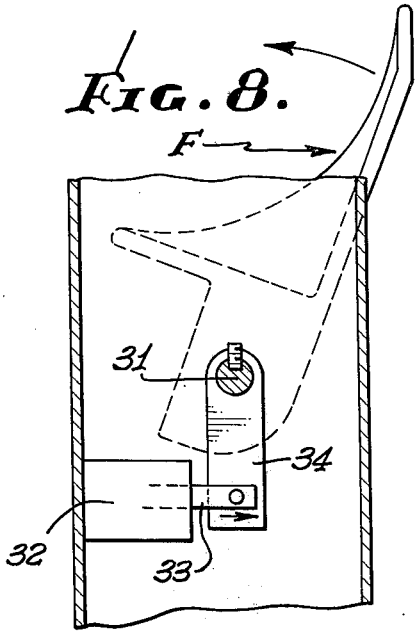
FIG. 8 is a detail view in section as taken on the line 8—8 of FIG. 6.

The finger means F comprise a plurality of vertically spaced finger units mounted upon horizontal shafts 31, each of which, as seen in FIG. 8, is rockable by a suitable solenoid 32 havings its armature 33 connected with a crank 34 fixed on the shaft 31. The solenoid 32 is adapted to actuate the finger units between open and closed positions. In the open position, the finger units direct a paper sheet carried by the belts 22 into a tray 30, and in the closed position these finger units allow a sheet to pass by for engagement with a lower open finger unit. In the preferred form, the solenoids are such that the fingers are normally open and are acutated to the closed position.

Figure 9:
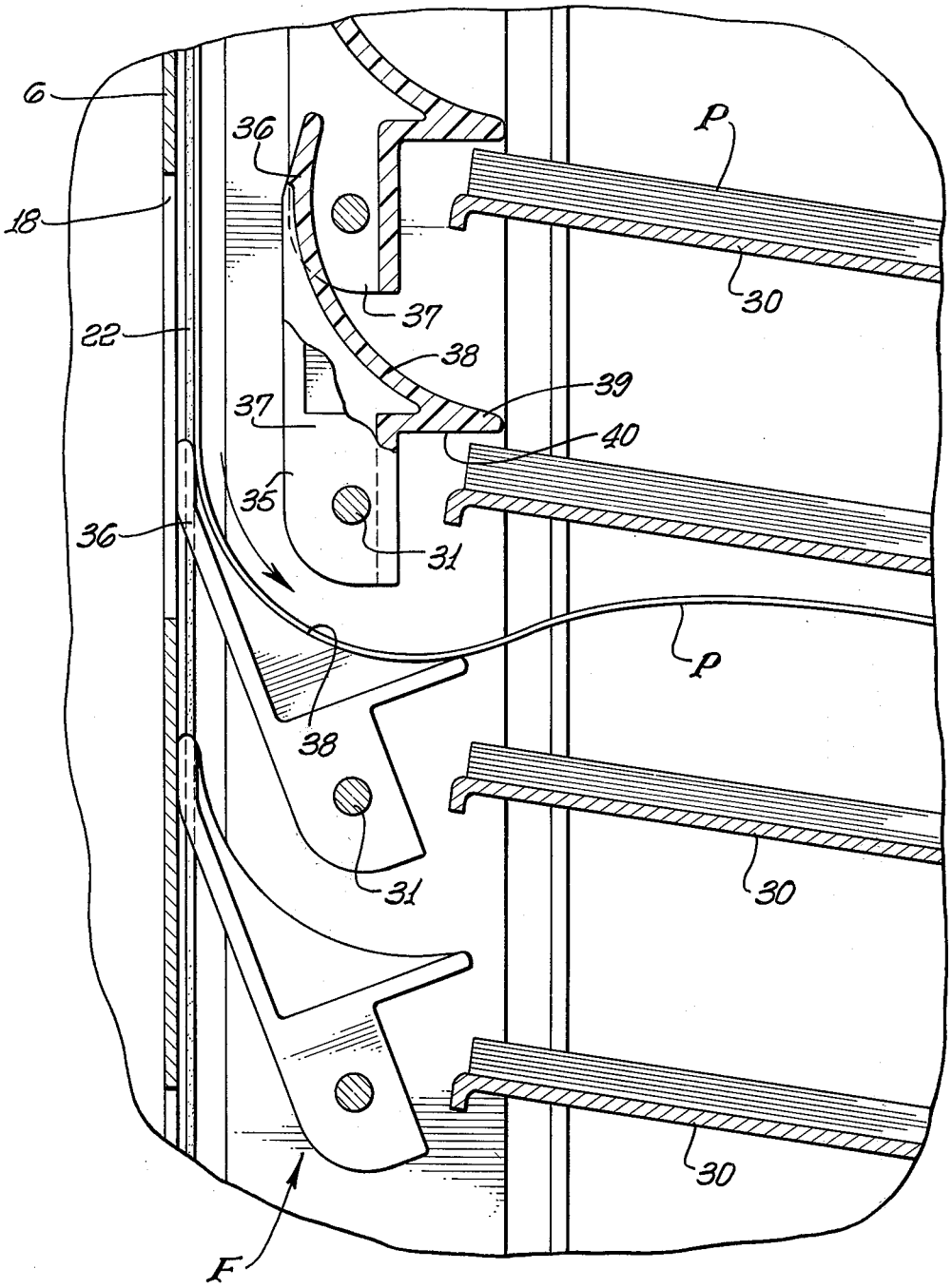
FIG. 9 is an enlarged fragmentary detail view showing the finger arrangement and mode of operation.

The respective finger units F comprise a body 35 of molded plastic fixed on a rock shaft 31 so as to be pivotal with the shaft, as seen in FIG. 9, between the open and closed positions. Extending upwardly from the body 35 is a plurality of laterally spaced fingers 36. The respective bodies 35 have laterally spaced notches or recesses 37 into which the fingers of a subjacent unit project when the fingers are closed, whereby the interfitting fingers and bodies afford an over-all substantially smooth, flat, vertical surface, without corners or rough edges, so that a sheet traveling downwardly on the belts will not impinge upon or become jammed with the closed finger units. The fingers 36 have a curved sheet engaging surface extending downwardly and inwardly towards a tray 30 to the end of an extension 39 providing an undersurface 40 projecting from the body 35. The respective finger bodies are positioned above the adjacent edge of a tray 30, so that when the fingers are closed, the surface 40 overlies the tray 30. When the fingers are open, the upper ends extend into the spaces between the belts on which the paper is carried. Accordingly, when a sheet S, as seen in FIG. 9, moves downwardly with the belts 22, the finger tips deflect the leading edge of the sheet from the belts and cause the sheet to be curved toward the tray and upwardly to clear any paper stacked in the tray. The sheets in the tray are prevented from curling upwardly by the overlapping undersurface 40 of the fingers.

Figure 7:
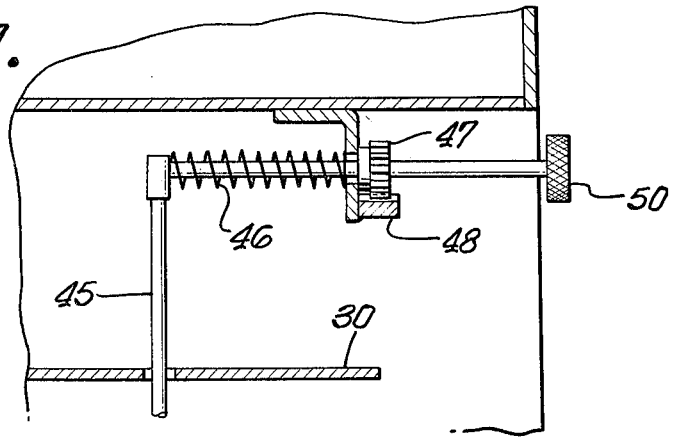
FIG. 7 is a fragmentary vertical section as taken on the line 7—7 of FIG. 3.
Figure 6:
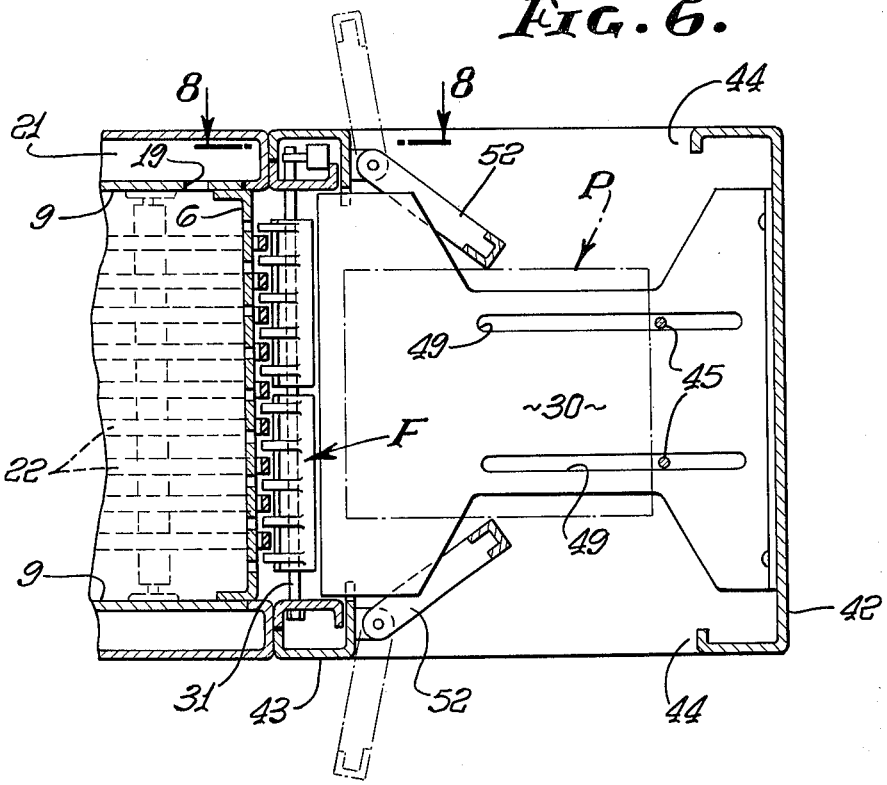
FIG. 6 is a fragmentary horizontal section as taken on the line 6—6 of FIG. 3.

As seen in FIG. 6, each tray is mounted on an end wall 42 and on posts 43 of the receiver section and is indented at each side to enable removal of a stack of sheets S from either side through housing openings 44. The trays are adapted to receive sheets of different sizes by means of adjustable stop rods 45 which depend from support arms 46 having pinions 47 engaged with horizontal racks 48 supported at the top of the housing. The rods depend through elongated slots 49 in the trays, so as to be adjustable towards and away from the finger means F by rotation of an operating knob 50, as seen in FIG. 7.

If desired wing side guides 52 may be pivotally mounted on the frame and moved to and from adjusted laterally spaced positions for centering a stack of sheets on the tray.

Figure 5:
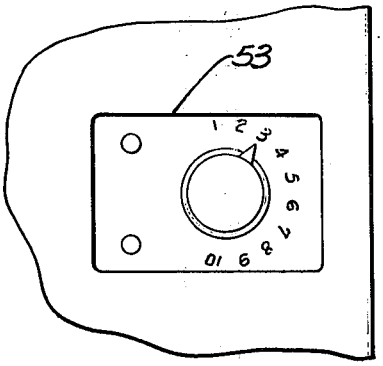
FIG. 5 is a fragmentary top plan as seen on the line 5—5 of FIG. 1.

Suitable electrical controls are provided, including a selector switch 53 (FIG. 5) to select the number of sheets to be sorted. Such controls may be enclosed in a box, such as the box 54 shown in FIG. 3, or elsewhere. Preferably, however, the machine is responsive to a sheet of paper being supplied to the inlet means 8 from the copier or source C. Accordingly, as seen in FIG. 3, a paper sensor 55 is provided at the paper inlet, say in the form of a photo electric cell adapted to turn the sorter on when a sheet is supplied to the inlet and to hold the machine on for a period of time. Under control of the selector switch 53, the fingers are adapted to be successively closed from top to bottom by control means 54, which may be a simple stepping switch, activated by each sheet of paper entering a tray and detected by sensor means such as a photo electric cell 56 located above the fingers.

From the foregoing it will be apparent that the invention provides a versatile sorting apparatus applicable to a wide range of sources of paper sheets to be sorted, the machine being simple to manufacture and operate as well as easy to service.

I claim:

1. In a sorting machine having walls defining a vacuum chamber, sheet carrying belts movable about said chamber, and receiver means for successively receiving the sheets from said belts in sorted relation, the improvement wherein said walls and belts have portions pivotal about a horizontal axis and provide a vertically adjustable sheet input section about which said belts move, whereby said machine is adapted to receive sheets from a source of selected height.

2. In a sorting machine as defined in claim 1, means for vertically adjusting said vertically adjustable section.

3. In a sorting machine as defined in claim 1, tensioning means for said belts adjustable responsive to adjustment of said vertically adjustable section to maintain uniform tension on said belts.

4. In a sorting machine as defined in claim 1, tensioning means for said belts adjustable responsive to adjustment of said vertically adjustable section to maintain uniform tension on said belts, and roller means slightly spacing said belts from said chamber.

5. In a sorting machine as defined in claim 1, control means including sensor means carried by said vertically adjustable section to detect the presence of a sheet on said section to activate the machine.

6. In a sorting machine as defined in claim 1, said receiver means including a plurality of trays, and finger means associated with each tray for removing successive sheets from said belts and directing said sheets to said trays.

7. In a sorting machine as defined in claim 1, said receiver means including a plurality of trays, and finger means associated with each tray for removing successive sheets from said sheets and directing said sheets to said trays, said finger means being normally disposed to remove an oncoming sheet from said belts and being adjustable to a position enabling the passage of a sheet.

8. In a sorting machine as defined in claim 1, said receiver means including a plurality of trays, and finger means associated with each tray for removing successive sheets from said sheets and directing said sheets to said trays, said finger means being normally disposed to remove an oncoming sheet from said belts and being adjustable to a position enabling the passage of a sheet, and including control means for causing actuation of successive fingers to the latter position when a sheet enters a tray.

9. In a sorting machine as defined in claim 1, said vertically adjustable section including input means for a sheet, an upper wall mounted for pivotal movement and an articulated lower wall connected with said upper wall.

10. In a sorting machine having walls defining a vacuum chamber, sheet carrying belts movable about said chamber, receiver means for successively receiving the sheets from said belts in sorted relation, said receiver means including a plurality of sheet receiver trays, and finger means actuatable between open and closed positions for picking off successive sheets from said belts and directing said sheets into said trays; the improvement wherein said finger means comprise fingers having bodies supporting said fingers in side by side spaced relation, said bodies having notches in side by side spaced relation therein, means supporting said bodies with said fingers disposed in said notches of an adjacent body when said fingers are closed to provide a sheet confining smooth path between said belts and said finger means, and said fingers having arcuate surfaces for directing said sheets from said path inwardly and upwardly with respect to said trays when said fingers are open.

11. In a sorting machine as defined in claim 10, said fingers having a surface opposed to a sheet in said tray, when said fingers are closed, to prevent curling of the trailing edge of a sheet in a tray.

12. A sorting machine comprising: a receiver having a plurality of vertically spaced trays, sheet transporting means for moving sheets successively to said receiver; finger means successively openable to deflect sheets from said transporting means into said trays, drive means for said transporting means, and actuator means for said finger means, said sheet transporting means comprising a vacuum chamber, fan means for evacuating said chamber, said chamber having an upper horizontal perforated wall and a vertical perforated wall pivotally interconnected for angular adjustment of said upper wall, and lower and side walls between said upper and vertical walls enabling said angular adjustment, sheet drive belts extending continuously about said upper, said vertical and said lower walls in transversely spaced relation, means for driving said belts to transport sheets thereon with said sheets held against said belts by external pressure, said vertical wall extending past said trays, and said finger means being operable to remove sheets from said belts along said vertical wall to deflect said sheets into said trays.

13. A sorting machine as defined in claim 12, including first support means for said trays and said fingers, second support means for said transport means, a base for said support means, and means shiftably supporting said first and second support means for movement between adjacent cooperative relation of said receiver and said transporting means and spaced relation therebetween.

14. A sorting machine as defined in claim 12, including first support means for said trays and said fingers, second support means for said transport means, a base for said support means, and means shiftably supporting said first and second support means for movement between adjacent cooperative relation of said receiver and said transporting means and spaced relation therebetween, and latch means for connecting said support means together for movement together on said base towards and away from a source of sheets.

15. A sorting machine as defined in claim 12, wherein said finger means include finger elements transversely spaced with respect to said belts, and having end portions extensible towards said vertical wall between said belts for deflecting a sheet from said belts and said vertical wall.

16. A sorting machine as defined in claim 12, including tensioning means for maintaining uniform tension on said belts throughout the range of adjustment of said upper wall.

17. A sorting machine as defined in claim 12, including control means responsive to the entry of a sheet into said transport means to initiate operation of said drive means for said transporting means and said actuator means for said finger means.

18. A sorting machine as defined in claim 12, including means at opposite sides of said upper wall for maintaining the latter in a horizontal disposition transversely thereof throughout the range of angular adjustment.

* * * * *